US006615803B2

(12) United States Patent
Kojima et al.

(10) Patent No.: US 6,615,803 B2
(45) Date of Patent: Sep. 9, 2003

(54) FUEL INJECTION CONTROL APPARATUS, CONTROL METHOD, AND CONTROL PROGRAM OF INTERNAL COMBUSTION ENGINE

(75) Inventors: Kazunori Kojima, Susono (JP); Junichi Kako, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/955,161

(22) Filed: Sep. 19, 2001

(65) Prior Publication Data

US 2002/0040705 A1 Apr. 11, 2002

(30) Foreign Application Priority Data

Oct. 4, 2000 (JP) ..... 2000-305204

(51) Int. Cl.[7] ..... F02M 51/00
(52) U.S. Cl. ..... 123/480; 123/492
(58) Field of Search ..... 123/480, 1 A, 123/478, 575, 492; 701/108, 109, 103, 104, 105

(56) References Cited

U.S. PATENT DOCUMENTS 5,467,757 A * 11/1995 Yanagihara et al. ..... 123/305
5,553,593 A * 9/1996 Schnaibel et al. ..... 123/682
5,626,115 A * 5/1997 Kawaguchi ..... 123/305
5,743,243 A * 4/1998 Yanagihara ..... 123/568.12
6,006,720 A * 12/1999 Yanagihara et al. ..... 123/305
6,067,965 A * 5/2000 Trumpy et al. ..... 123/480
6,343,467 B1 * 2/2002 Muto et al. ..... 60/285

FOREIGN PATENT DOCUMENTS

| | | |
|---|---|---|
| JP | A 6-123246 | 5/1994 |
| JP | B2 2705298 | 10/1997 |
| JP | A 11-218043 | 8/1999 |

* cited by examiner

*Primary Examiner*—John Kwon
(74) *Attorney, Agent, or Firm*—Oliff & Berridge, PLC

(57) ABSTRACT

In a fuel injection control apparatus of an internal combustion engine for controlling a fuel supply quantities by making use of a fuel behavior model obtained by modeling the dynamic behavior of fuel flowing from injector into combustion chamber of cylinder of engine, the fuel behavior model is configured to estimate the dynamic fuel behavior such as attachment onto and detachment from a wall surface, e.g., using separate quantities, a wall surface adhesion quantity Fwv(k) of a low boiling point component and a wall surface adhesion quantity Fwp(k) of a high boiling point component at each time k, and to control an injected fuel quantity Fi(k) so that a fuel quantity Fc(k) of fuel flowing into the cylinder becomes a target value.

13 Claims, 5 Drawing Sheets

FUEL INJECTION CONTROL APPARATUS, CONTROL METHOD, AND CONTROL PROGRAM OF INTERNAL COMBUSTION ENGINE

BACKGROUND OF THE INVENTION

1. Field of the Invention

The present invention relates to fuel injection control of an internal combustion engine and, more particularly, to control of fuel supply quantity from a fuel injection system by a model for the behavior of fuel, which is obtained by modeling the dynamic behavior of fuel.

2. Related Background Art

As apparatus for controlling the fuel supply to the internal combustion engine according to operating conditions, there is known control technology by a fuel behavior model to control the fuel injection system by setting a mathematical model describing the fuel behavior in an inlet system and calculating the mathematical model set from operating conditions and fuel conditions to simulate the fuel behavior, thereby determining a necessary fuel supply quantity.

An example of this technology is one disclosed in Japanese Patent No. 2705298. The Japanese patent describes that this technology is one of calculating a fuel state quantity in an intake pipe, based on an atomizing model for expressing a state quantity of fuel atomization and a wall flow model for assigning fuel deposit quantities according to an intake-pipe wall surface portion and an intake-valve surface portion, and it can enhance the control accuracy of injected fuel quantity.

SUMMARY OF THE INVENTION

The fuel quality needs to be taken into consideration in order to estimate the fuel behavior. However, gasoline commonly used as fuel for the internal combustion engines does not consist of a single component in fact, but it is a mixture consisting of many components of different carbon numbers, which are mixed in either of various component ratios. It is thus difficult to estimate the behavior of fuel accurately. For that reason, for example, the above-stated technology employs an approach of representing the fuel quality by some selected types of components and determining values of physical properties for a combination of the components.

However, this approach is approximation on the assumption that multi-component mixtures behave in the same manner, and does not allow us to estimate different behaviors of the respective components. In particular, the property of fuel adhering to the wall surfaces etc. also varies with occurrence of change in pressure and temperature in the intake pipe, which can affect the fuel behavior, but the above approach can not respond to this change and thus fails to properly estimate the fuel behavior, thus degrading the control accuracy of supplied fuel.

An object of the present invention is, therefore, to provide a technique of controlling the fuel injection in the internal combustion engine, using a fuel behavior model capable of properly estimating the fuel behavior in accordance with change in the property of adhering fuel on the wall.

In order to accomplish the above object, a fuel injection control apparatus, a fuel control method, and a fuel control program of an internal combustion engine according to the present invention are based on a technology of controlling a fuel supply quantity from a fuel injection system by making use of a fuel behavior model obtained by modeling dynamic behavior of fuel flowing from the fuel injection system into a cylinder of the internal combustion engine, wherein the fuel supply quantity from the fuel injection system is controlled by making use of the fuel behavior model as a combination of behavior models of a plurality of fuel components having different boiling points.

The present invention makes it feasible to estimate the fuel behavior, particularly the behavior of adhering fuel on the wall, more accurately by the combination of behavior models of the plurality of fuel components having the different boiling points, and thus can enhance the control accuracy of supplied fuel. The behavior models of the fuel components do not have to be prepared in the number of kinds of the components included in the fuel, but behavior models in the smaller number than it permit the fuel behavior to be estimated with hither accuracy than the conventional behavior model does; estimation can be effected well by preparing at least two types of models.

It is preferable further to detect a fuel quality by detecting a predetermined physical property and correct a component ratio of the plurality of fuel components in the fuel behavior model according to the fuel quality detected.

Since in this configuration the control is arranged to detect the change in the property of supplied fuel and vary the structure of the fuel behavior model according thereto, it becomes feasible to estimate the fuel behavior more accurately in accordance with the change in the property of fuel and thus to enhance the control accuracy of supplied fuel.

The present invention will be more fully understood from the detailed description given here in below and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
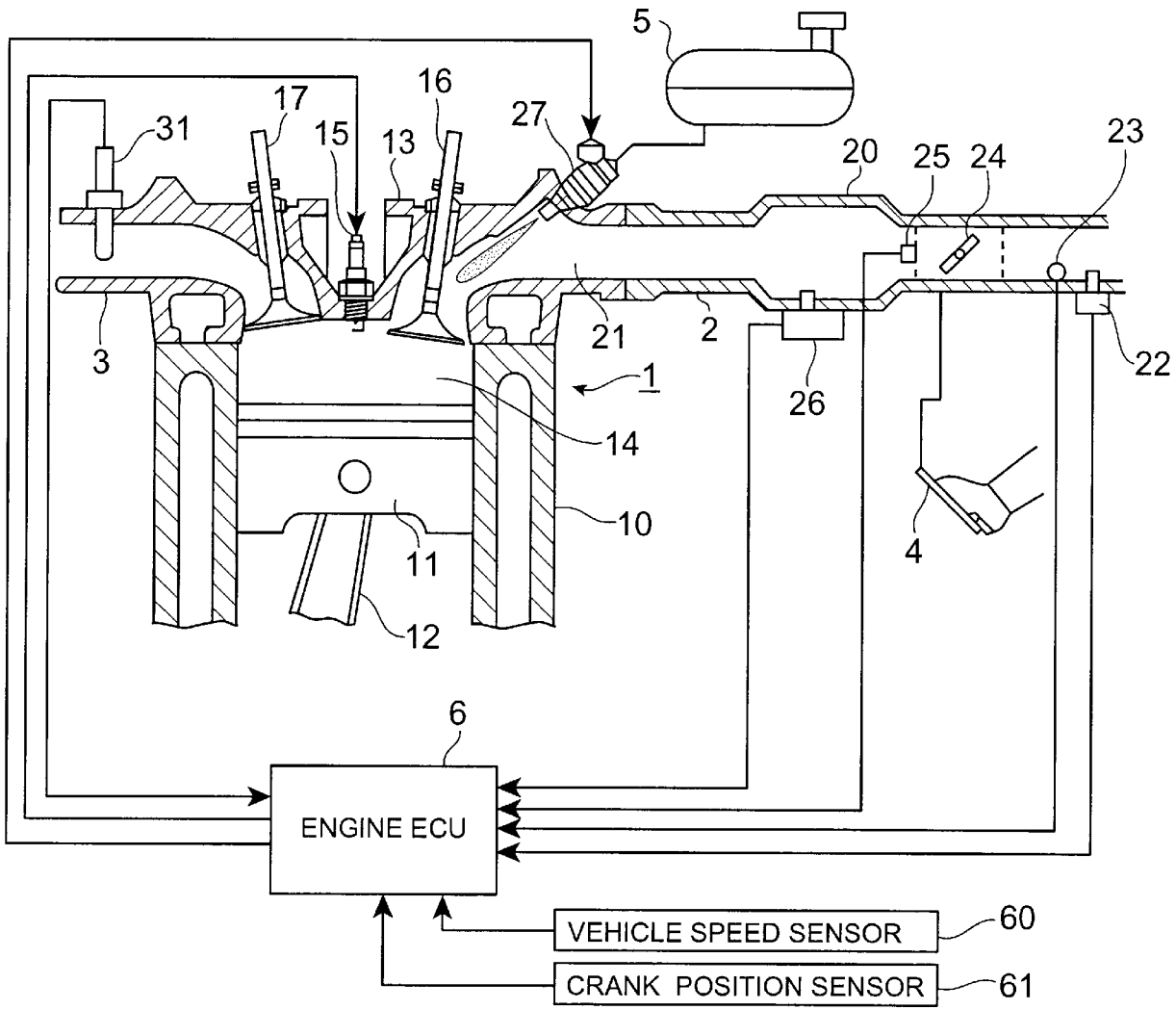
FIG. 1 is a schematic structure diagram showing a fuel injection system and an internal combustion engine adopting the present invention.

The preferred embodiments of the present invention will be described below in detail with reference to the accompanying drawings. To facilitate the comprehension of the explanation, the same reference numerals denote the same parts, where possible, throughout the drawings, and a repeated explanation will be omitted.

FIG. 1 is a structural diagram showing an internal combustion engine to which the fuel injection control technology of the internal combustion engine according to the present invention is applied.

Intake pipe 2 and exhaust pipe 3 are connected to a spark injection type multi-cylinder internal gasoline combustion engine (which will be referred to hereinafter simply as an engine) 1. The intake pipe 2 is provided with an intake-air temperature sensor 22 for detecting the temperature of intake air, an air flow meter 23 for detecting an intake air volume, a throttle valve 24 moving in synchronism with operation of an accelerator pedal 4, and a throttle sensor 25 for detecting an opening degree of the throttle valve 24. A surge tank 20 of the intake pipe 2 is equipped with an intake-air pressure sensor 26 for detecting the pressure in the intake pipe 2. Further, an injector (fuel injection system) 27 of an electromagnetic drive type is provided at an intake port 21 connected to each cylinder of the engine 1, and gasoline as fuel is supplied from a fuel tank 5 to this injector 27. The engine 1 illustrated is a multipoint injection system in which injectors 27 are independently located at respective cylinders.

A piston 11 reciprocating vertically in the figure is provided in cylinder 10 making each cylinder of the engine 1, and a crankshaft (not shown) is coupled through a connecting rod 12 to the piston 11. A combustion chamber 14 defined by cylinder 10 and cylinder head 13 is formed above the piston 11. A spark plug 15 is mounted in the upper part of the combustion chamber 14 and the combustion chamber 14 is connected through openable/closable intake valve 16 and exhaust valve 17 to the intake pipe 2 and to the exhaust pipe 3, respectively.

An air-fuel ratio sensor 31, which outputs a predetermined electric signal according to an oxygen content in the exhaust gas, is mounted on the exhaust pipe 3.

An engine ECU (electronic control unit) 6 (including the fuel injection control apparatus of the internal combustion engine according to the present invention) for controlling the engine 1 is mainly comprised of a microcomputer, accepts output signals from the above-stated sensors (intake-air temperature sensor 22, air flow meter 23, throttle sensor 25, intake-air pressure sensor 26, and air-fuel ratio sensor 31), vehicle speed sensor 60, and crank position sensor 61, and controls the action of spark plugs 15 and injectors 27.

Figure 2:
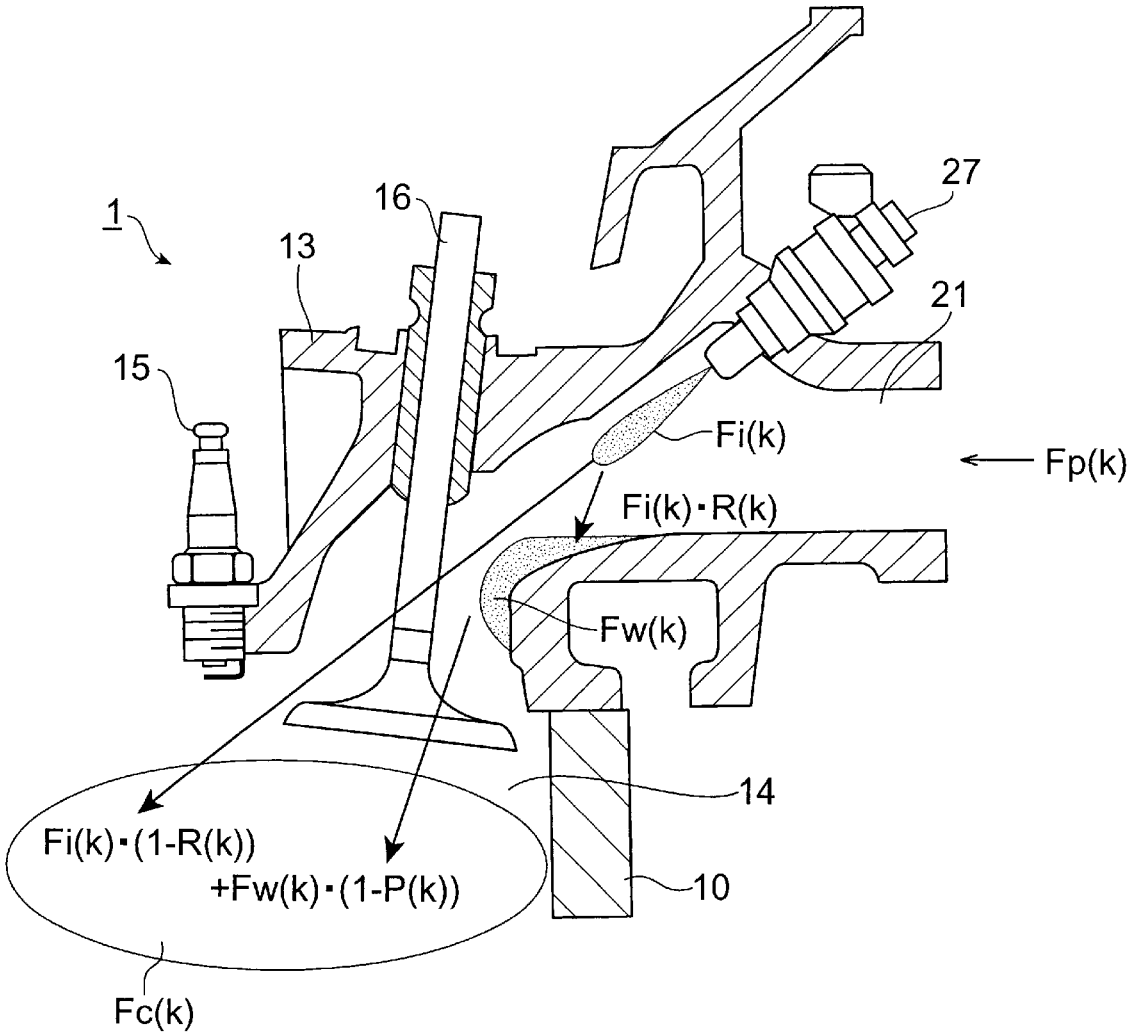
FIG. 2 is a diagram for explaining the conventional fuel behavior model (primary model).

Before describing the fuel behavior model used in the fuel injection control technology of the internal combustion engine according to the present invention, we will explain the fuel behavior model used heretofore, with reference to FIG. 2. FIG. 2 is a schematic diagram showing the simulation model of fuel behavior in the vicinity of injector 27 (near the intake port 21). In the description below, a counter value indicating a time will be indicated by "k" in consideration of numerical processing by computer.

In FIG. 2, Fi(k) indicates a quantity of fuel injected from the injector 27 at the time k (injector injection quantity), Fw(k) indicates a quantity of fuel adhering on the wall surface of the exhaust port 21 and the surface of the intake valve 16 on the intake port 21 side (which will be referred to hereinafter as the wall surface of intake port 21 and the like) at the time k (wall adhering fuel quantity), and Fc(k) indicates a quantity of fuel flowing into the cylinder (or into the combustion chamber 14 in the cylinder 10) at the time k (in-cylinder flowing fuel quantity). Let R(k) be a rate of fuel adhering on the wall surface of intake port 21 and the like (wall surface adhesion rate) out of the injector injection quantity Fi(k) at the time k and P(k) be a rate of fuel remaining on the wall surface of intake port 21 and the like without evaporating (wall surface residual rate) out of the wall adhering fuel quantity Fw(k) at the time k. Then Equations (1) and (2) below hold. These equations are generally known as equations of C. F. Akino.

$$Fw(k+1)=Fw(k)\cdot P(k)+Fi(k)\cdot R(k) \quad \Lambda(1)$$

$$Fc(k)=Fw(k)\cdot(1-P(k))+Fi(k)\cdot(1-R(k)) \quad \Lambda(2)$$

On the other hand, a target in-cylinder flowing fuel quantity Fcr(k), which represents a quantity of fuel to be actually supplied into the cylinder at the time k when combustion is implemented at a target air-fuel ratio (mixture ratio A/F) λ, is expressed by the following equation, where Q(k) indicates an intake air volume.

$$Fcr(k)=Q(k)/\lambda \quad \Lambda(3)$$

It is seen from Eqs (1) to (3) that, in order to match the aforementioned in-cylinder flowing fuel quantity Fc(k) with this target in-cylinder flowing fuel quantity Fcr(k), the injection quantity Fi(k) of the injector 27 needs to be controlled to the quantity given by the following equation.

$$Fi(k) = \frac{Fcr(k) - Fw(k)\cdot(1 - P(k))}{1 - R(k)} \quad \Lambda(4)$$

Namely, in order to control the in-cylinder flowing fuel quantity Fi(k) so as to control the air-fuel ratio properly, it is necessary to accurately calculate the wall-surface adhering fuel quantity Fw(k), which is calculated by Eq (1), and set the parameters P(k) and R(k) to appropriate values.

Figure 3:
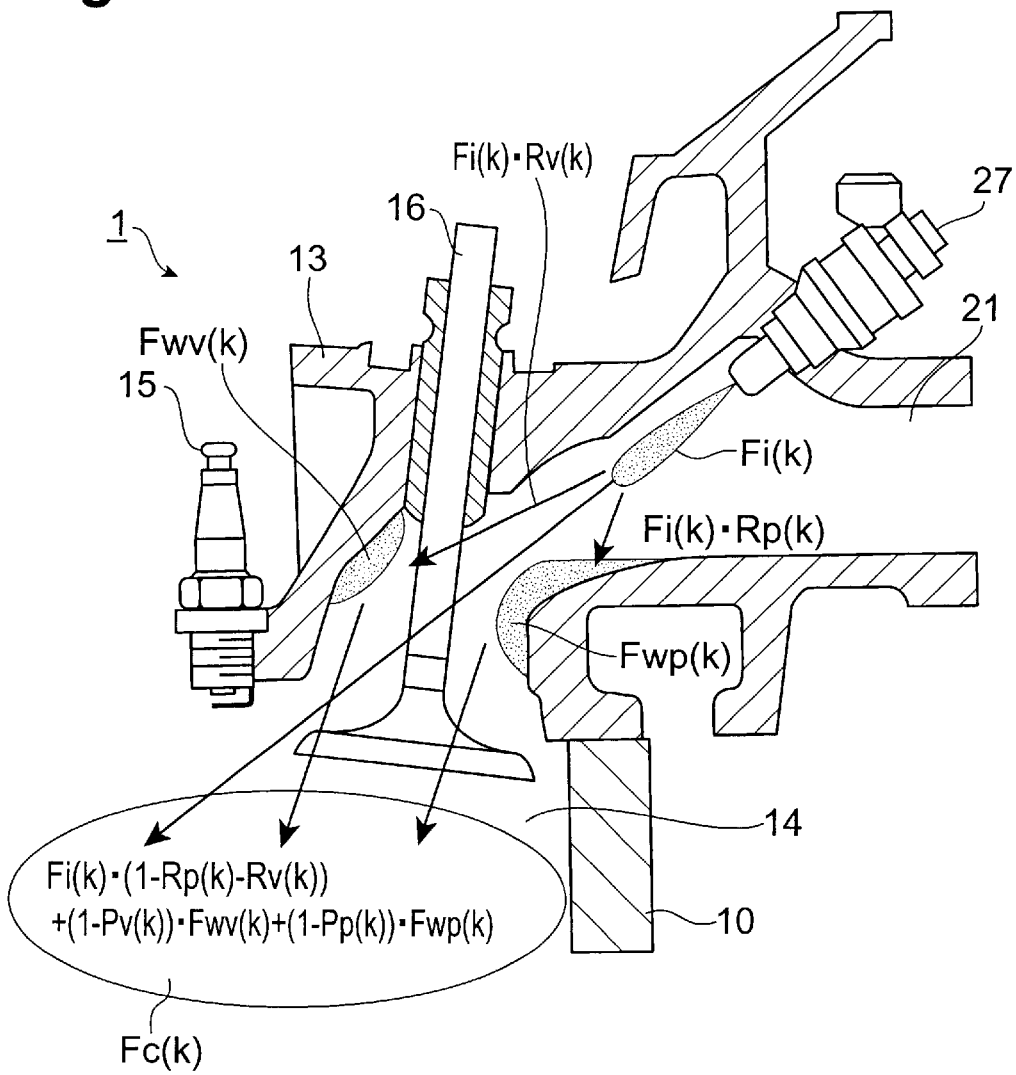
FIG. 3 is a diagram for explaining the fuel behavior model (secondary model) used in the present invention.
Figure 4:
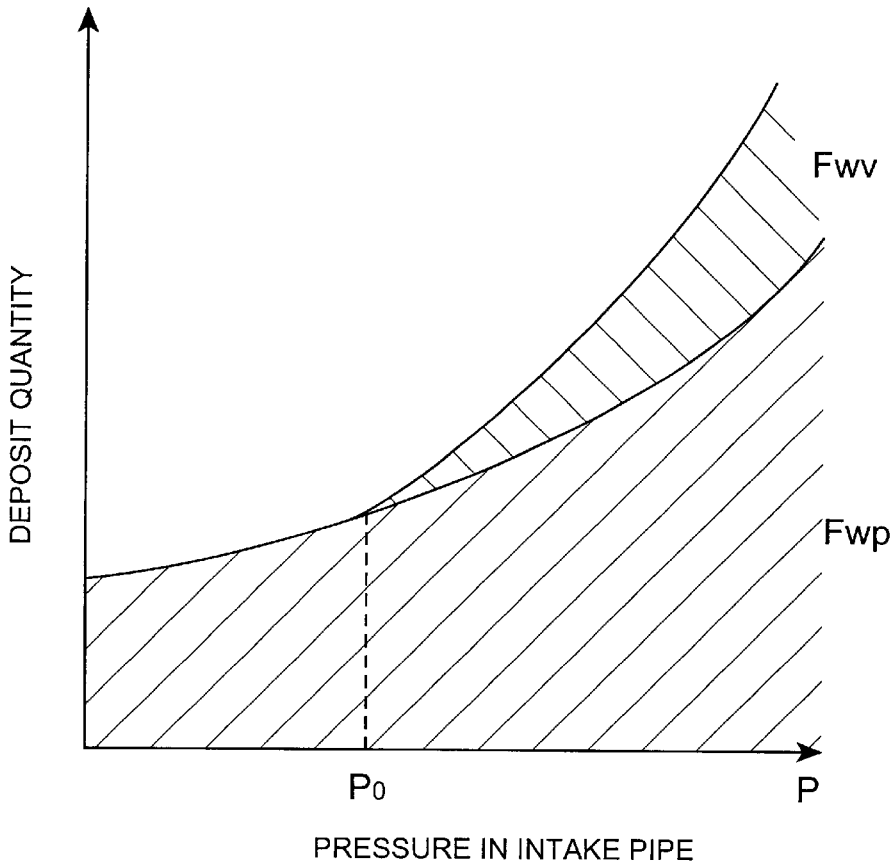
FIG. 4 is a diagram for explaining a fuel quality.

It was difficult to properly control the in-cylinder flowing fuel quantity Fi(k), particularly, during deceleration and acceleration by the conventional control method using Eq (4). In order to solve this problem, the fuel behavior model used in the fuel injection control technology according to the present invention employs a plurality of wall surface adhesion behavior models described for respective components. The fuel behavior model in the present invention will be described below with reference to FIGS. 3 and 4. FIG. 3 is a schematic diagram showing a simulation model of fuel behavior near the intake port 21 and FIG. 4 is a graph for explaining quality change in adhesion quantity against change in intake-pipe pressure. Described herein is a model of two components consisting of to separate wall surface adhering behavior models of a high boiling point component and a low boiling point component, but the same also applies to cases of models for three or more separate components having different boiling points (vapor pressures).

Gasoline, which is the fuel commonly used in the internal combustion engines as described previously, is a mixture consisting of many components having different boiling points in fact. If these are divided into two component, a low boiling point component with a low boiling point and a high boiling point component with a high boiling point, deposit quantities Fwv, Fwp of these components adhering on the wall surface of intake port 21 and the like vary as shown in FIG. 4 against intake-pipe pressure.

Since a saturated vapor pressure $p_0$ of the low boiling point component is relatively high, almost all of the low boiling point component evaporates and does not adhere on the wall surface (Fwv=0) in the range where the intake-pipe pressure is below the saturated vapor pressure $p_0$. In contrast to it, in the case of the high boiling point component, since the saturated vapor pressure thereof is low, it always adheres on the wall surface at intake-pipe pressures within the operating range.

In the fuel behavior model shown in FIG. 3, the wall surface adhering fuel quantity at the time k is described by two separate quantities, a wall surface adhering fuel quantity Fwv(k) of the low boiling point component and a wall surface adhering fuel quantity Fwp(k) of the high boiling point component. As for the rate of fuel adhering on the wall surface of intake port 21 and the like (wall surface adhesion rate) out of the injector injection quantity Fi(k) at the time k, let Rv(k) be a wall surface adhesion rate of the low boiling point component (in fact, a product of a rate Kv(k) of the low boiling point component in the injected fuel and a rate R'v(k) of the low boiling point component adhering on the wall surface and the like out of the injected low boiling point component), and Rp(k) be a wall surface adhesion rate of the high boiling point component (in fact, a product of a rate Kp(k) of the high boiling point component in the injected fuel and a rate R'p(k) of the high boiling point component adhering on the wall surface and the like out of the injected high boiling point component). Further, let Pv(k) be a rate of the low boiling point component remaining on the wall surface of intake port 21 and the like without evaporating (wall surface residual rate of the low boiling point component) out of the wall surface adhering fuel quantity Fwv(k) of the low boiling point component at the time k, and Pp(k) be a rate of the high boiling point component remaining on the wall surface of intake port 21 and the like without evaporating (wall surface residual rate of the high boiling point component) out of the wall surface adhering fuel quantity Fwp(k) of the high boiling point component at the time k. Then Eqs (1) and (2) can be rewritten into Eqs (5) to (7) below.

$$Fwv(k+1)=Fwv(k)\cdot Pv(k)+Fi(k)\cdot Rv(k) \quad \Lambda(5)$$

$$Fwp(k+1)=Fwp(k)\cdot Pp(k)+Fi(k)\cdot Rp(k) \quad \Lambda(6)$$

$$Fc(k)=Fwv(k)\cdot(1-Pv(k))+Fwp(k)\cdot(1-Pp(k))+Fi(k)\cdot(1-Rv(k)-Rp(k)) \quad \Lambda(7)$$

Here relations R'v(k)<R'p(k)<1 and Kv(k)+Kp(k)=1 hold, so that the relation Rv(k)+Rp(k)<1 holds.

From Eq (3) and Eqs (5) to (7), the injection quantity Fi(k) of the injector 27 needs to be controlled so as to satisfy the following equation in order to match the aforementioned in-cylinder flowing fuel quantity Fc(k) with the target in-cylinder flowing fuel quantity Fcr(k).

$$Fi(k) = \frac{Fcr(k) - \{Fwp(k)\cdot(1 - Pp(k)) + Fwv(k)\cdot(1 - Pv(k))\}}{1 - Rv(k) - Rp(k)} \quad \Lambda(8)$$

The above control is executed by the engine ECU 6. Namely, this control is stored in the form of a control program in the microcomputer consisting the engine ECU 6. Specifically, the engine ECU 6 determines a set air-fuel ratio, based on engine operating conditions (a vehicle speed obtained from the vehicle speed sensor 60, an engine speed obtained from the crank position sensor 61, etc.), at each time k. Then an intake air volume is calculated from outputs of the intake-air temperature sensor 22, air flow meter 23, intake-air pressure sensor 26, and throttle sensor 25 and the target Fcr(k) of in-cylinder flowing fuel quantity is set based thereon. Then the parameters in above-stated Eqs. (5) to (7) are set from the engine operating conditions and others to determine the wall surface adhering fuel quantities Fwv(k), Fwp(k) of the respective components and the quantity Fi(k) of fuel to be injected from the injector 27 is determined based on Eq (8). Then the action of the injector 27 is controlled so as to inject the fuel in the fuel quantity thus determined. The parameters are stored in the engine ECU 6 in the form of a map based on the engine operating conditions and it is preferable further to implement parameter learning to correct the parameters if there is a large deviation between the control result and the target, based on the output signal of the air-fuel ratio sensor 31.

Figure 5A:
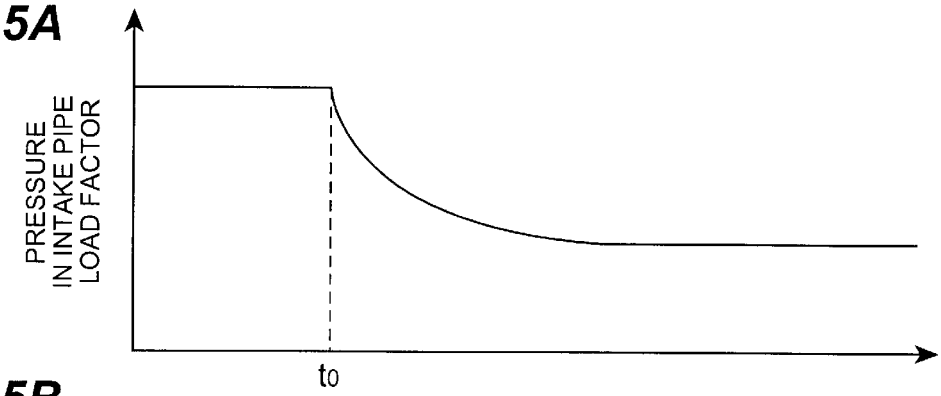
FIGS. 5A to 5D are a diagram for explaining the results of control by the primary model and the secondary model in comparison with each other.

FIG. 5A to SD are diagrams for explaining the results of fuel supply control with the fuel behavior model shown in FIG. 3 (which will be referred to as a secondary model) according to the present invention and with the conventional fuel behavior model shown in FIG. 2 (which will be referred to as a primary model) in comparison with each other. Let us explain an example of control during decrease of load (for example, during deceleration) in which controllability is the lowest in the conventional fuel behavior model.

As the load factor is reduced by releasing the accelerator pedal 4 from a time to as shown in FIG. 5A, the throttle valve 24 becomes closed in synchronism with the accelerator pedal 4 and thus the intake-pipe pressure (absolute pressure) decreases.

Figure 5B:
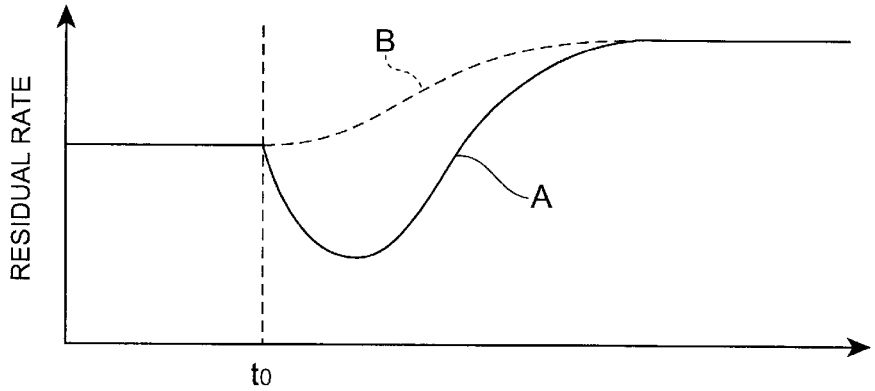

With decrease in the intake-pipe pressure, the low boiling point component having the lower boiling point out of the fuel components adhering on the wall surface come to be detached from the wall surface quicker. Namely, the residual rate on the wall surface (mainly, Pp(k)) decreases temporarily. This phenomenon cannot be simulated by the primary model, as indicated by a dashed line B in of FIG. 5B, and the primary model predicts that the residual rate increases with decrease of the load. On the other hand, this phenomenon can be simulated accurately by the secondary model, as indicated by a solid line A.

Figure 5C:
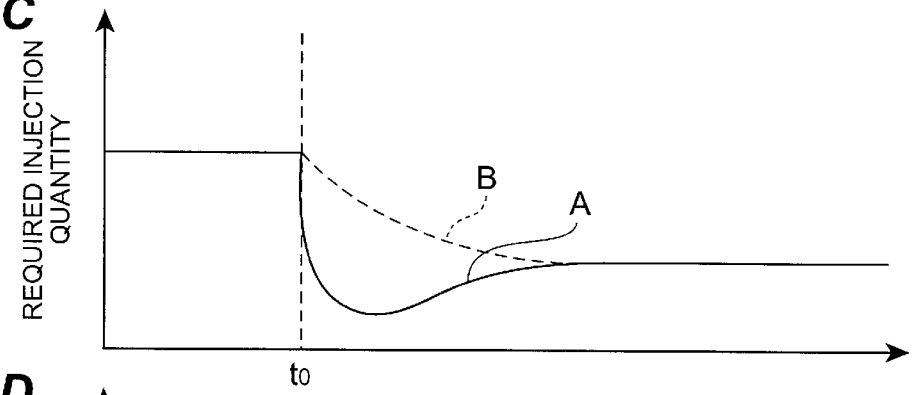

As a result, required injection quantities to the injector 27, determined by the two models, are as shown in FIG. 5C. Namely, in the secondary model, the required injection quantity is decreased by the amount of the adhering fuel detached from the wall surface in the initial stage of reduction of the load and thus the required injection quantity largely decreases temporarily as indicated by a solid line A. On the other hand, in the primary model, the detachment phenomenon of the low boiling point component is not simulated well, and thus the decrease of required injection quantity becomes as gentle as the variation of the load.

Figure 5D:
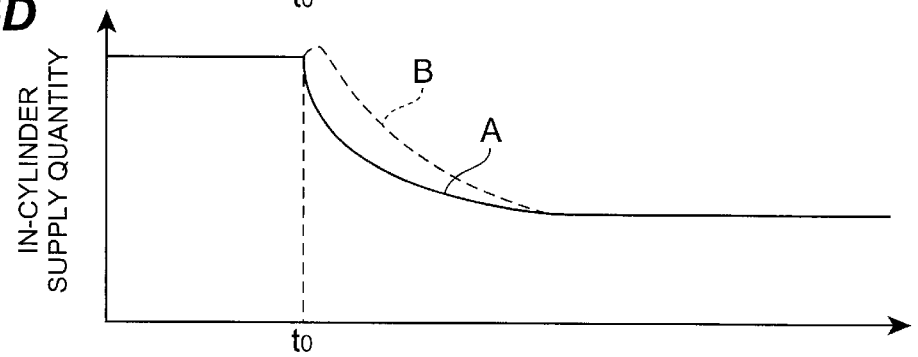

Quantities of fuel eventually flowing into the cylinder according to the control by the two control models are as shown in of FIG. 5D. Namely, since the conventional primary model fails to accurately simulate the detachment of the adhering fuel from the wall surface in the initial stage of reduction of the load, there appears a temporary supply increase phenomenon due to influence of the detachment immediately after the start of reduction of the load, as indicated by a dashed line B. This supply increase will shift the air-fuel ratio to the rich side, so as to result in degrading exhaust emission and degrading drivability due to failure in deceleration according to driver's intention.

In contrast to it, since the secondary model can accurately simulate the detachment of adhering fuel from the wall surface in the initial stage of reduction of the load, the fuel supply into the cylinder can be decreased according to the decrease of the load factor, so that the air-fuel ratio can be kept approximately constant. Accordingly, the emission is improved and the deceleration is effected according to driver's intention, thus also improving the driveability, as compared with the conventional control.

Since the ratio of fuel components (equivalent to the rates Kp(k) and Kv(k) of the respective components in the case of the two-component fuel behavior model as described above) varies depending upon properties of supplied fuel, it is preferable to determine this ratio by measuring the fuel properties such as specific gravity, vapor pressure, etc. and perform the calculation according to the fuel behavior model, based thereon. It can also be contemplated that the properties of fuel charged during fueling or the like are entered.

Without directly detecting the fuel properties themselves, the component ratio may also be corrected by learning similar to that for the other parameters such as the adhesion rates and residual rates, with feedback of control results. This configuration can obviate the need for the means for detecting the fuel properties, and thus can realize the present invention in simpler structure.

Fuel behavior models that can be used in the present invention do not always have to be limited to the above-described model. For example, positions of adhesion of fuel may be divided finer, e.g., into the valve surface and the wall surface of intake port, or the models may reflect adhesion in the cylinder. In use of these models, behaviors of respective fuel components can also be considered, which is encompassed in the technical scope of the present invention.

What is claimed is:

1. A fuel injection control apparatus of an internal combustion engine comprising a control section for controlling a fuel supply quantity from a fuel injection system by making use of a fuel behavior model obtained by modeling dynamic behavior of fuel flowing from the fuel injection system into a cylinder of the internal combustion engine, wherein said control section performs the control of the fuel supply quantity from said fuel injection system by making use of the fuel behavior model as a combination of behavior models of a plurality of fuel components having different boiling points.

2. The fuel injection control apparatus according to claim 1, further comprising means for detecting a fuel quality by detecting a predetermined physical property, wherein said control section corrects a component ratio of said plurality of fuel components in said fuel behavior model according to the fuel quality detected.

3. The fuel injection control apparatus according to claim 1, wherein said behavior models are models each of which independently calculates a wall surface adhesion quantity and an evaporation quantity of each component.

4. The fuel injection control apparatus according to claim 1, wherein said behavior models correct a model parameter by learning.

5. An internal combustion engine, comprising:

a fuel injection control apparatus; and a fuel injection system for injecting fuel, wherein said fuel injection control apparatus comprises a control section for controlling a fuel supply quantity from said fuel injection system by making use of a fuel behavior model obtained by modeling dynamic behavior of fuel flowing from the fuel injection system into a cylinder of the internal combustion engine, and said control section performs the control of the fuel supply quantity from said fuel injection system by making use of the fuel behavior model as a combination of behavior models of a plurality of fuel components having different boiling points, said fuel injection system injecting fuel based on the control by said fuel injection control apparatus.

6. A fuel injection control method of an internal combustion engine comprising a step of determining a fuel supply quantity of fuel to be supplied from a fuel injection system by making use of a fuel behavior model obtained by modeling dynamic behavior of fuel flowing from the fuel injection system into a cylinder of the internal combustion engine and controlling a fuel supply quantity from the fuel injection system to the thus determined fuel supply quantity, wherein said fuel behavior model is comprised of a combination of behavior models of a plurality of fuel components having different boiling points.

7. The fuel injection control method according to claim 6, further comprising a step of detecting a fuel quality by detecting a predetermined physical property, wherein a component ratio of the plurality of fuel components is corrected according to the fuel quality detected in said fuel behavior model.

8. The fuel injection control method according to claim 6, wherein said behavior models are models each of which independently calculates a wall surface adhesion quantity and an evaporation quantity of each component.

9. The fuel injection control method according to claim 6, wherein said behavior models correct a model parameter by learning.

10. A fuel injection control program of an internal combustion engine comprising a step of determining a fuel supply quantity of fuel to be supplied from a fuel injection system by making use of a fuel behavior model obtained by modeling dynamic behavior of fuel flowing from the fuel injection system into a cylinder of the internal combustion engine and controlling a fuel supply quantity from the fuel injection system to the thus determined fuel supply quantity, wherein said fuel behavior model is comprised of a combination of behavior models of a plurality of fuel components having different boiling points.

11. The fuel injection control program according to claim 10, further comprising a step of calculating a fuel quality from a predetermined physical property, wherein a component ratio of the plurality of fuel components is corrected according to the fuel quality detected in said fuel behavior model.

12. The fuel injection control program according to claim 10, wherein said behavior models are models each of which independently calculates a wall surface adhesion quantity and an evaporation quantity of each component.

13. The fuel injection control program according to claim 10, wherein said behavior models correct a model parameter by learning.

* * * * *